US010045908B2

(12) United States Patent
Aelen et al.

(10) Patent No.: US 10,045,908 B2
(45) Date of Patent: Aug. 14, 2018

(54) AUTOMATED CARDIO PULMONARY RESUSCITATION DEVICE WITH A RIGHT ANGLE ROPE AND PULLEY ASSEMBLY

(71) Applicant: KONINKLIJKE PHILIPS N.V., Eindhoven (NL)

(72) Inventors: Paul Aelen, Eindhoven (NL); Willem-Jan Van Rooij, Neunen (NL); Pierre Hermanus Woerlee, Valkenswaard (NL); Igor Wilhelmus Franciscus Paulussen, Neunen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 391 days.

(21) Appl. No.: 14/766,903

(22) PCT Filed: Feb. 6, 2014

(86) PCT No.: PCT/IB2014/058827

§ 371 (c)(1),
(2) Date: Aug. 10, 2015

(87) PCT Pub. No.: WO2014/128583

PCT Pub. Date: Aug. 28, 2014

(65) Prior Publication Data

US 2015/0374579 A1 Dec. 31, 2015

Related U.S. Application Data

(60) Provisional application No. 61/768,691, filed on Feb. 25, 2013.

(51) Int. Cl.
*A61H 31/00* (2006.01)

(52) U.S. Cl.
CPC ... *A61H 31/006* (2013.01); *A61H 2201/1215* (2013.01); *A61H 2201/14* (2013.01);
(Continued)

(58) Field of Classification Search
None
See application file for complete search history.

(56) References Cited

U.S. PATENT DOCUMENTS 1,536,327 A 5/1925 Cartlibge
3,489,140 A * 1/1970 Mullikin ..... A61H 31/006 601/41

(Continued)

FOREIGN PATENT DOCUMENTS

CN 201308612 Y 9/2009
CN 101692995 A 4/2010

(Continued)

OTHER PUBLICATIONS

"Line Shaft Pulleys and Belting", Industrial Antiquity, Downloaded From http://www.old-engine.com/belts2.htm on Nov. 4, 2016, 12 Pages.

(Continued)

*Primary Examiner* — Stephen R Crow

(57) ABSTRACT

An automated cardio pulmonary resuscitation device comprises a front structure with first and second movable unit arranged to move back and forth along said front structure, a compression element for compressing a patient's chest, two arms coupled to the chest pad, one end of each of the arms being coupled to a respective one of the first and second movable units, driving means arranged for, when in operation, driving the first and second movable unit back and forth. The front structure comprises a transmission system including a driving pulley and a transmission rope, the transmission rope being arranged to be driven by the driving pulley, and said first and second movable units being coupled to the transmission rope so as to move back and forth in a translational motion along the front structure.

12 Claims, 3 Drawing Sheets

(52) U.S. Cl.
CPC ..... *A61H 2201/1621* (2013.01); *A61H 2201/1664* (2013.01)

(56) References Cited

U.S. PATENT DOCUMENTS

| | | | | |
|---|---|---|---|---|
| 4,459,124 | A | 7/1984 | Newton | |
| 6,066,106 | A * | 5/2000 | Sherman | A61H 31/006 601/134 |
| 6,070,103 | A | 5/2000 | Ogden | |
| 6,171,267 | B1 * | 1/2001 | Baldwin, II | A61H 31/00 601/106 |
| 6,174,295 | B1 * | 1/2001 | Cantrell | A61H 31/00 601/41 |
| 6,651,413 | B2 | 11/2003 | Papke | |
| 2014/0005578 | A1 | 1/2014 | Woerlee et al. | |

FOREIGN PATENT DOCUMENTS

| | | | |
|---|---|---|---|
| CN | 101744714 | A | 6/2010 |
| WO | 2005037179 | A1 | 4/2005 |
| WO | 2010049861 | A1 | 5/2010 |
| WO | 2010119401 | A1 | 10/2010 |
| WO | 2011073878 | A1 | 6/2011 |
| WO | 2012038855 | A1 | 3/2012 |
| WO | 2013030700 | A1 | 3/2013 |

OTHER PUBLICATIONS

Castle Valley Mill, Third Floor Clutch Device, Article downloaded from fttp://www.lousweb.com/castle%20valley%20mill/power_clutch.htm, on Sep. 26, 2012.

* cited by examiner

AUTOMATED CARDIO PULMONARY RESUSCITATION DEVICE WITH A RIGHT ANGLE ROPE AND PULLEY ASSEMBLY

CROSS-REFERENCE TO PRIOR APPLICATIONS

This application is the U.S. National Phase application under 35 U.S.C. § 371 of International Application No. PCT/IB2014/058827, filed on Feb. 6, 2014, which claims the benefit of U.S. Provisional Patent Application No. 61/768,691, filed on Feb. 25, 2013. These applications are hereby incorporated by reference herein.

FIELD OF THE INVENTION

The invention relates to the field of cardiopulmonary resuscitation, and more specifically to automated cardiopulmonary resuscitation. The invention addresses a cardiopulmonary resuscitation apparatus comprising a cardio pulmonary resuscitation unit comprising a main body with a compression pad.

BACKGROUND OF THE INVENTION

Cardiopulmonary resuscitation (CPR) is a well-known technique for increasing the chance for survival from cardiac arrest. However, it is very difficult to perform manual cardiopulmonary resuscitation with consistent high quality. Since CPR quality is key for survival there is a strong drive to have a mechanical automated device to replace less reliable and long duration manual chest compressions. Automated CPR (A-CPR) apparatuses were introduced in the market recently.

Some A-CPR systems use a pneumatic actuator mechanism while other A-CPR systems are driven by an electrical motor such as a servo motor. An A-CPR system typically comprises a backboard and an A-CPR unit having a mechanical heart-stimulator such as a compression pad, and possibly respiratory aid or electrodes for electrical resuscitation. During use, a patient is placed on the backboard, back down, and the A-CPR-unit is attached to the backboard. When doing so, it is important to transfer the force provided by mechanical heart-stimulator from the A-CPR-unit to the patient's sternum in a controlled but still forceful way.

Document WO 2010/049861 A1 discloses one such A-CPR system with an A-CPR-unit connectable to a backboard and a transmission system to control movement of a compression element. The transmission system comprises an electrical motor/gearbox combination and a transmission pulley to transfer power to two sliders that repetitively move back and forth over a guiding rail. The movement of the two sliders results in a back and forth vertical motion of the compression element to perform resuscitation. The translational motion of the sliders is obtained by changing the direction of the motor.

The electrical motor may be placed in a vertical way within the ACPR device. This option is cumbersome. For small system size, the motor/gearbox combination may be placed in the horizontal direction, so that the output shaft of the motor/gearbox is parallel to the horizontal plane and the direction of rotational motion of the pulley makes a 90 degree angle with the translation in the horizontal direction. A 90 degree angle has to be made.

Mechanisms to transfer power in a right (90 degree) angle are known. For example, a 90 degree gearbox consists of an input and output shaft that are connected by a ring and pinion or a spiral bevel gear and pinion. However, such 90 degree gearboxes have to be sufficiently large to transfer the high required moments if significant forces have to be transferred, leading to cumbersome gearboxes. Further disadvantages relate to its low efficiency and the amount of noise and vibration as the gears move along each.

Another way to transfer power over a 90 degree angle is by using a timing belt or a chain running over sprocket that is driven by a driving pulley and makes a 90 degree turn by two guide pulleys. The belt has to be twisted to make the 90 degree angle. To overcome twist the distance between pulleys has to be large. Instead of belts, ropes in both the continuous and multiple drive systems have been contemplated.

It would be desirable to have an automatic CPR system with a system for converting movement from horizontal motion into the vertical plane.

It would be further desirable to have a system for transferring power in a right angle, while maintaining low cost, high endurance and low noise.

SUMMARY OF THE INVENTION

To better address one or more of these concerns, the present invention proposes an automated cardio pulmonary resuscitation device comprising a front structure with first and second movable unit arranged to move back and forth along said front structure, a compression element for compressing a patient's chest, two arms coupled to the chest pad, one end of each of the arms being coupled to a respective one of the first and second movable units, driving means arranged for, when in operation, driving the first and second movable unit back and forth. The front structure comprises a transmission system including a first driving pulley and a transmission rope, the transmission rope being arranged to be driven by the driving pulley, and said first and second movable units being coupled to the transmission rope so as to move back and forth in a translational motion along the front structure.

The present disclosure therefore proposes using a transmission rope for the force transmission, achieving a very compact and low cost design. A transmission rope can be coupled between the driving pulley and the moveable units, without twisting when turns are provided.

The automated cardio pulmonary resuscitation device preferably comprises a first guide pulley, the transmission rope being arranged to make a 90 degree turn over said first guide pulley, in the direction in which the translational motion has to be made. The transmission rope is preferably round shaped and can therefore make the 90° turn in a compact and efficient manner, without twisting In one aspect of the disclosure, the automated cardio pulmonary resuscitation device comprises an idler pulley for guiding back the transmission rope to a second driving pulley, wherein the transmission rope is arranged to make a 180 degree turn over said idler pulley and another 90 degree over the second guide pulley. The transmission rope is preferably round shaped and can therefore be routed on the pulleys to achieve a good force transmission.

In one aspect of the disclosure, a first end of the transmission rope is connected to the first drive pulley, through complementary connection elements on the transmission rope side and on the driving pulley side, wherein the transmission rope comprises an end loop for securing therein a connection element. With an end loop and a connection element, the transmission rope can be fixedly coupled to the driving pulley.

By forming the end loop through splicing the transmission rope, the transmission rope may comprises the end loop and an overlapping part. The overlapping part advantageously has a double amount of material, which in turn results in a smaller force acting on the yarns. This allows increasing the lifetime of the transmission rope whilst preventing the rope from flattening when force is acting on the transmission rope.

In one aspect of the present disclosure, the overlapping part extends over a range of 10 cm and 100 cm. The overlapping part extends over the first guide pulley and preferably extends over the idler pulley. This ensures that the forces are transferred with a double amount of materials which reduce wear and increases lifetime. This also helps preventing the transmission rope from flattening at the driving pulley and idler pulley.

By providing a connection element as a dumbbell secured with the end loop, the dumbbell being secured in a corresponding attachment hole of the first driving pulley, an economic design can be achieved.

In another aspect of the resent disclosure, a clamping device for the connection of the transmission rope to the first and the second movable units is provided, the clamping device including at least two guiding plates between which the transmission rope is tightened. The use of a clamping device with two guiding plates allows a reliable tight connection of the rope, yet avoiding that the transmission rope slips.

In a further aspect of the present disclosure, the transmission rope comprises at least one of polymer material, Kevlar, aramid, and steel. In yet another aspect, the transmission rope comprises Ultra high molecular weight polyethylene. Steel is economic. A polymer material is flexible, lightweight, and easy to bend. Kevlar or aramid are hight strength materials capable of handling high forces.

Preferably, the transmission rope has a thickness in the range of about 3 mm and 5 mm. The transmission rope has preferably 8 or 12 strands, and a braid cycle length of about 15 to 35 stitches per 10 cm.

BRIEF DESCRIPTION OF THE DRAWINGS

These and other aspects of the invention will be apparent from and elucidated with reference to the embodiment(s) described herein after, given as examples only, in which.

DETAILED DESCRIPTION OF THE EMBODIMENTS

Figure 1:
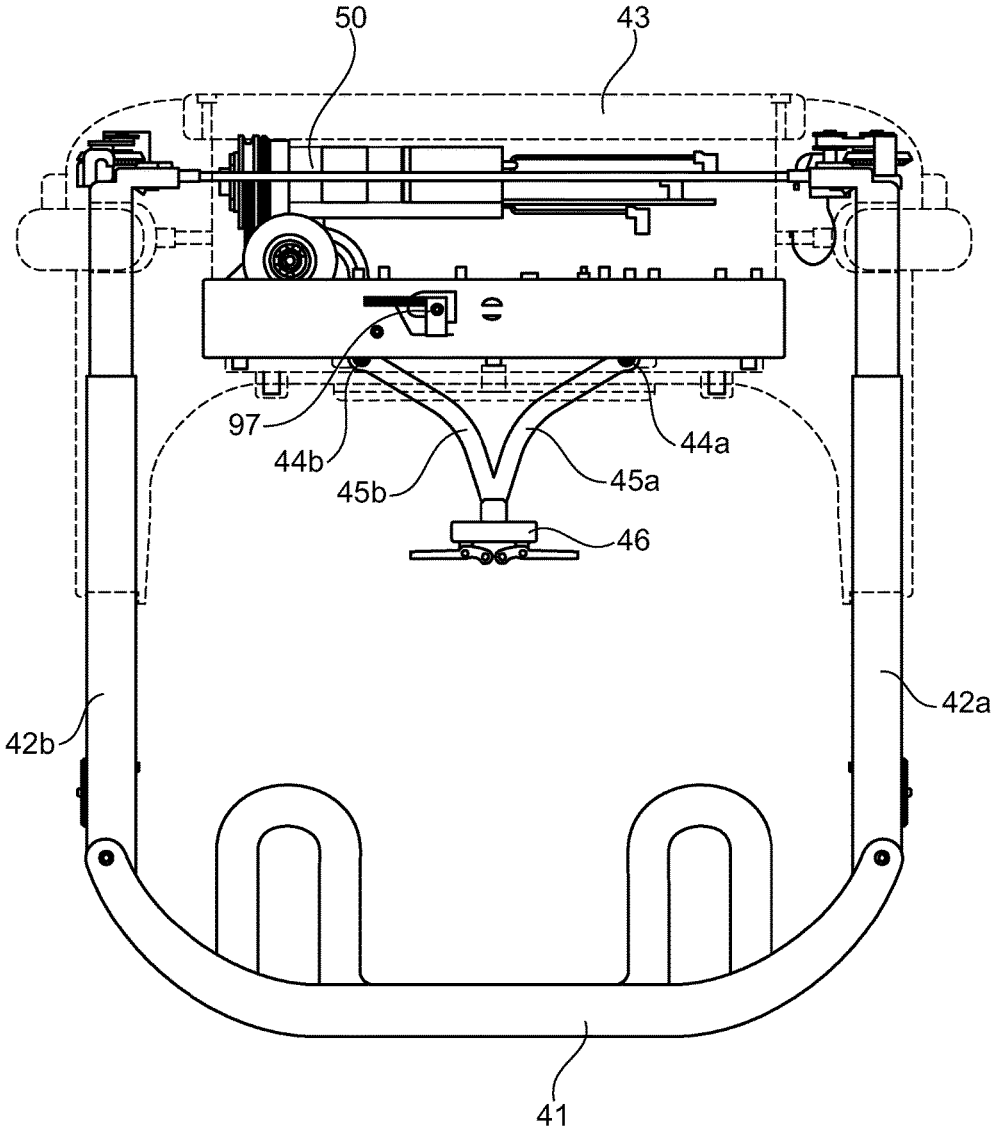
FIG. 1 shows a schematic drawing of a cardio pulmonary resuscitation (CPR) assembly according to one aspect of the invention.
Figure 2:
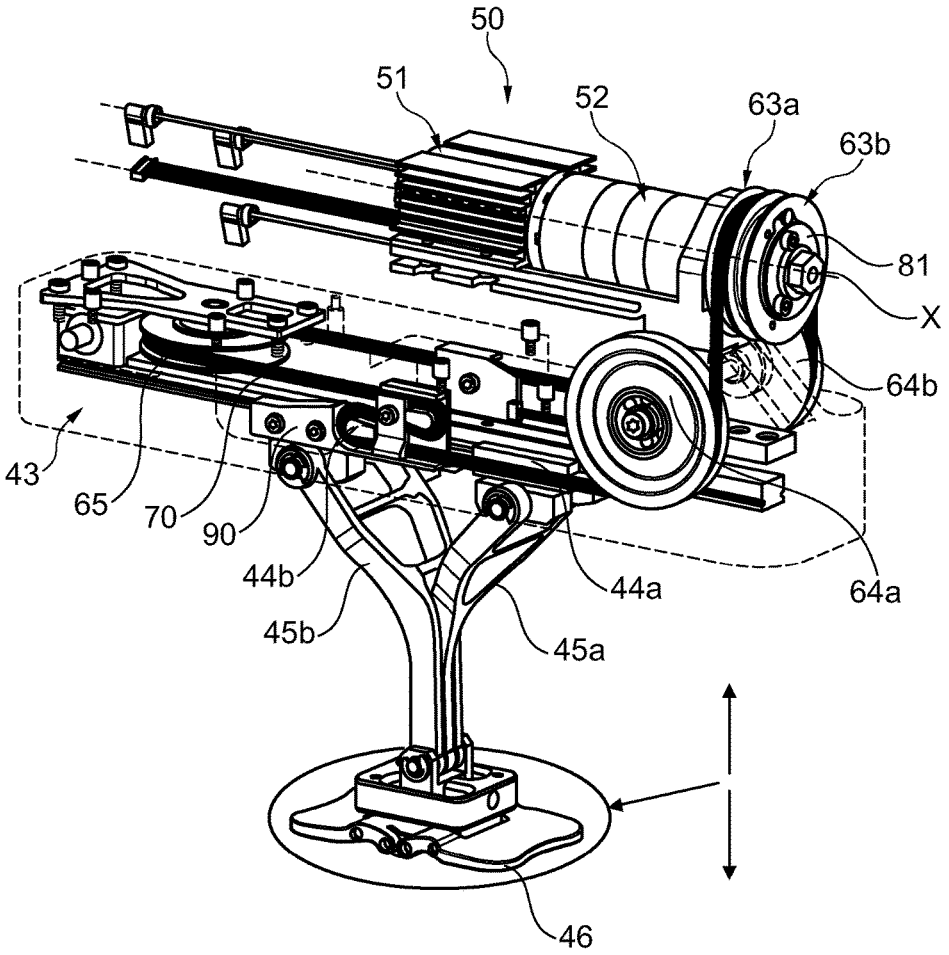
FIG. 2 shows a detailed view of the automated cardio pulmonary resuscitation assembly of FIG. 1.

FIG. 1 shows a schematic drawing of the automated CPR device for cyclically compressing a patient's chest according to a first aspect of the invention. FIG. 2 shows a detailed view of the automated cardio pulmonary resuscitation assembly of FIG. 1.

The CPR device comprises a back support 41 for positioning behind the patient's back. Two upstanding columns 42*a,b* are attached at their lower part to the back support 41. A front structure 43 is connected to the upstanding columns 42*a,b* at their upper part. The back support 41 is arranged to keep the front structure 43 in a fixed position, or in a relatively fixed position, relative to the patient's back. The front structure 43 comprises a first and a second movable unit 44*a,b* arranged to move back and forth along said front structure 43.

The CPR device further comprises a chest pad 46 as compression element arranged to contact and compress/decompress the patient's chest. Two arms 45*a,b* are each rotatably coupled to the chest pad 46 with one end and each arm is rotatably coupled to a respective one of the first and the second movable units 44*a,b*. The two arms 45*a,b* may be rotatably, or pivotally, coupled to the chest pad 46 at either separate points of the chest pad 46, or preferably at a single, common point having a common rotational, or pivotal, axis. The CPR device further comprises driving means 50 arranged for, when in operation, driving the first and the second movable units 44*a,b* back and forth such that the chest pad 46 cyclically compresses the patient's chest.

As shown in FIG. 2, the driving means comprises preferably a motor 51 with a gear system 52. The motor 51 may be an electromagnetic motor, or more specifically, a brush (less) DC motor which provides a rotational force, but pneumatic or hydraulic means could also be arranged to provide the required motion of the units 44*a,b*. The motor 51 is preferably servo controlled, as known to the person skilled in the art. A battery supplies the power to the motor 51.

The gear system 52 has an output shaft having a rotational axis X, arranged parallel to the direction of translation motion, parallel to the back support 41 in the described embodiment. The output shaft is connected to a driving pulley 63*a* to which a first end of a transmission rope 70 is attached. The transmission rope 70 makes a 90 degree turn over a first guide pulley 64*a* in the direction in which the translational motion of the movable unit 44*a*, 44*b* has to be made. The transmission rope 70 is guided back to a second driving pulley 63*b* by making a 180 degree turn over an idler pulley 65 and another 90 degree over a second guide pulley 64*b*. The second end of the transmission rope is there connected to the second drive pulley 63*b*.

The first and second drive pulleys 63*a*, 63*b* are preferably coaxial, and arranged to rotate around the same rotation axis which is aligned with the rotational axis of the output shaft. The first and second guide pulleys 64*a*, 64*b* are preferably coaxial, and arranged to rotate around the same rotation axis which is orthogonal to the rotational axis X of the output shaft.

Figure 3:
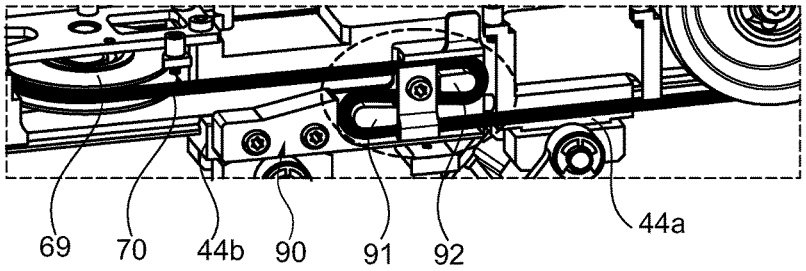
FIG. 3 shows a detailed view of transmission system which can be used in an automated cardio pulmonary resuscitation assembly of FIGS. 1 and 2.

A clamping device 90 is provided for connecting the transmission rope 70 to the the first and the second movable units 44*a,b*. As illustrated on FIG. 3, the clamping device 90 comprises guiding plates, between which the transmission rope 70 is routed and secured. The guiding plates 91, 92 are preferably parallel to each other and mounted parallel to the front structure, in a vertical position when the ACPR unit is in operative position. The guiding plates may be either fastened to each other and to the movable units, e.g. using screws, or the guiding plates may be integral with the movable unit.

When the motor 51 rotates, the driving pulley 63*a* rotates together with the transmission rope 70. As a result, the movable units 44*a*, 44*b* undergo a translation motion in opposite direction one to the other so as to move back and forth in a translational motion along the front structure. This in turn results into a translation motion of the compression pad 46. When the motor 51 rotates e.g. clockwise, both arms 45*a*, 45*b* of the V-drive are pulled to the center of the drive (direction reversed by the pulley), the compression element goes down. When the motor rotation is reversed the arms 45*a*, 45*b* move into the opposite direction.

Figure 4:
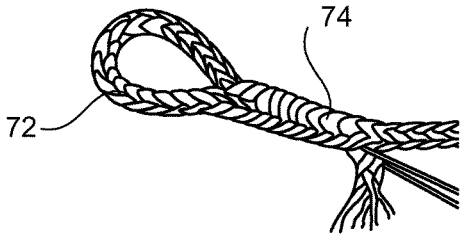
FIG. 4 shows a transmission rope which can be used in an automated cardio pulmonary resuscitation assembly according to one aspect of the invention.
Figure 5:
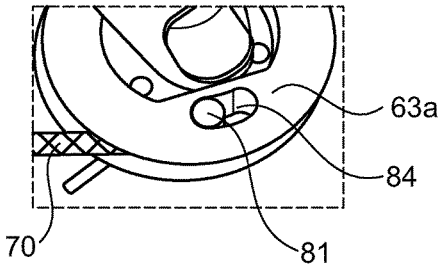
FIG. 5 shows a transmission rope and pulley which can be used in an automated cardio pulmonary resuscitation assembly according to one aspect of the invention.

As illustrated on FIGS. 4 and 5, the connection of the transmission rope 70 to the driving pulley 63*a* is achieved through complementary first and second connection elements 81, 84 on the transmission rope side and on the driving pulley side, respectively. On FIG. 3, only the first driving pulley 63*a* and one connection is illustrated, but a similar connection is achieved between the second end of the rope and the second driving pulley 63*b*.

The transmission rope comprises an end loop 72 for securing therein a connection element 81. The first connection element 81 is a dumbbell secured with the end loop 72. The end loop/dumbbell assembly is secured in a corresponding attachment hole 84 that forms the second connection element 84 on the driving pulley 63*a*.

The end loop 72 may be done by splicing the transmission rope 70, thereby forming said end loop for securing therein the connection element 81. The splicing of the transmission rope 70 results in an overlapping part 74. The overlapping part 74 advantageously has a double amount of material, yarns in case of polymer material, which in turn results in a smaller force acting on the yarns. This allows increasing the lifetime of the transmission rope 70 whilst preventing the rope from flattening when force is acting on the transmission rope 70.

The overlapping part may extend over a range of 10 cm and 100 cm. The overlapping part extends up to the idler pulley, thereby ensuring that the forces are transferred with a double amount of materials and preventing the transmission rope from flattening at the driving pulley and idler pulley which reduces wear and increases lifetime. The transmission rope preferably comprises ultra-high molecular weight polyethylene. A polymer material is flexible, light weight and easy to bend. Other preferred materials include Kevlar, aramid, or steel.

To allow for a good efficiency/lifetime ratio, the transmission rope has preferably a thickness in the range of about 3 mm and 5 mm. Further, a 12 strand rope provides good results.

The transmission rope 70 is guided to the two movable units 44*a*, 44*b* to which the transmission rope 70 is connected. By making several bends of the transmission rope between the guiding plates 91, 92, the contact area of the rope is maximised, allowing a tight connection between the sliders and the rope, preventing the transmission rope from slipping.

It should be understood by those skilled in this art, that the present invention might be practiced in other embodiments that do not conform exactly to the details set forth herein, without departing significantly from the spirit and scope of this disclosure. In this context, and for the purposes of brevity and clarity, detailed descriptions of well-known apparatuses, circuits and methodologies have been omitted so as to avoid unnecessary detail and possible confusion.

What is claimed is:

1. An automated cardio pulmonary resuscitation device comprising a front structure with first and second movable units arranged to move back and forth along said front structure, a compression element for compressing a patient's chest, two arms coupled to the compression element, one end of each of the arms being coupled to a respective one of the first and second movable units, driving means arranged for, when in operation, driving the first and second movable unit back and forth, wherein the front structure comprises a transmission system including a first driving pulley and a transmission rope, the transmission rope being arranged to be driven by the driving pulley, and said first and second movable units being coupled to the transmission rope so as to move back and forth in a translational motion along the front structure, and wherein a first end of the rope is connected to the first drive pulley, through complementary connection elements on the transmission rope and on the driving pulley, wherein the transmission rope comprises an end loop for securing therein a connection element, the end loop being formed by splicing the transmission rope, the transmission rope comprising the end loop and an overlapping part.

2. The automated cardio pulmonary resuscitation device according to claim 1, comprising a first guide pulley, the transmission rope being arranged to make a 90 degree turn over said first guide pulley, in the direction of the translational motion.

3. The automated cardio pulmonary resuscitation device according to claim 1, further comprising an idler pulley for guiding back the transmission rope to a second driving pulley, wherein the transmission rope is arranged to make a 180 degree turn over said idler pulley and another 90 degree turn over a second guide pulley.

4. The automated cardio pulmonary resuscitation device according to claim 1, the overlapping part extends over a range of 10 cm and 100 cm.

5. The automated cardio pulmonary resuscitation device according to claim 4, the overlapping part extends over the idler pulley.

6. The automated cardio pulmonary resuscitation device according to claim 1, wherein the connection element is a dumbbell secured with the end loop, the dumbbell being secured in a corresponding attachment hole of the first driving pulley.

7. The automated cardio pulmonary resuscitation device according to claim 1, comprising a clamping device for the connection of the transmission rope to the first and the second movable units, the clamping device including at least two guiding plates between which the transmission rope is tightened.

8. The automated cardio pulmonary resuscitation device according to claim 1, wherein the transmission rope comprises at least one of polymer material, Kevlar, aramid, and steel.

9. The automated cardio pulmonary resuscitation device according to claim 1, wherein the transmission rope comprises Ultra high molecular weight polyethylene.

10. The automated cardio pulmonary resuscitation device according to claim 1, wherein the transmission rope has a thickness in the range of about 3 mm and 5 mm.

11. The automated cardio pulmonary resuscitation device according to claim 1, wherein the transmission rope has either 8 or 12 strands.

12. The automated cardio pulmonary resuscitation device according to claim 1, wherein the transmission rope has a braid cycle length of about 15 to 35 stitches per 10 cm.

* * * * *